US008500968B2

(12) United States Patent
Woodruff et al.

(10) Patent No.: US 8,500,968 B2
(45) Date of Patent: Aug. 6, 2013

(54) DEPLATING CONTACTS IN AN ELECTROCHEMICAL PLATING APPARATUS

(75) Inventors: Daniel J. Woodruff, Kalispell, MT (US); Nolan L. Zimmerman, Kalispell, MT (US); John L. Klocke, Kalispell, MT (US); Klaus H. Pfeifer, Kalispell, MT (US); Kyle M. Hanson, Kalispell, MT (US); Matthew Herset, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 502 days.

(21) Appl. No.: 12/856,357

(22) Filed: Aug. 13, 2010

(65) Prior Publication Data

US 2012/0037495 A1 Feb. 16, 2012

(51) Int. Cl.
*C25D 17/00* (2006.01)

(52) U.S. Cl.
USPC ..... 204/194; 204/212

(58) Field of Classification Search
USPC ..... 204/194, 212
See application file for complete search history.

(56) References Cited

U.S. PATENT DOCUMENTS

| | | | |
|---|---|---|---|
| 6,623,609 | B2 | 9/2003 | Harris et al. |
| 7,351,314 | B2 | 4/2008 | Klocke et al. |
| 7,371,306 | B2 | 5/2008 | Davis |
| 7,585,398 | B2 | 9/2009 | Hanson et al. |
| 2002/0066471 | A1 | 6/2002 | Peace et al. |
| 2002/0083960 | A1 | 7/2002 | Wirth et al. |
| 2004/0222101 | A1 | 11/2004 | Ajmera et al. |
| 2006/0289302 | A1 | 12/2006 | Hanson |

OTHER PUBLICATIONS

Korean Intellectual Property Office, International Search Report and Written Opinion for PCT/US2011/047406, Mar. 20, 2012.

*Primary Examiner* — Keith Hendricks
*Assistant Examiner* — Stefanie Sherrill
(74) *Attorney, Agent, or Firm* — Perkins Coie LLP

(57) ABSTRACT

An electroplating apparatus having improved contact deplating features includes a bowl assembly having a bowl for holding an electroplating solution. A head having a rotor including a contact ring and a head motor for rotating the rotor cooperates with the bowl assembly during plating operations. A lift/rotate actuator may be used to move the head to position a sector of the contact ring in a ring slot or opening of a deplating module. Since the deplating is performed within the deplating module, and not within the bowl assembly, the electroplating solution in the bowl assembly is not affected by the deplating process.

15 Claims, 14 Drawing Sheets

DEPLATING CONTACTS IN AN ELECTROCHEMICAL PLATING APPARATUS

BACKGROUND OF THE INVENTION

Microprocessors, memory devices, field-emission-displays, read write heads and other microelectronic devices generally have integrated circuits with microelectronic components. A large number of individual microelectronic devices are generally formed on a semiconductor wafer, a glass substrate, or another type microelectronic workpiece. In a typical fabrication process, one or more thin metal layers are formed on the workpieces at various stages of fabricating the microelectronic devices to provide material for constructing interconnects between various components.

The metal layers are often applied to the workpieces via electrochemical plating in an electroplating reactor or machine. A typical electroplating reactor includes a container for holding an electroplating solution, an anode in the container to contact the electroplating solution, and a support mechanism having a contact assembly with multiple electrical contacts that engage the seed-layer. The electrical contacts are coupled to a power supply to apply a voltage to the workpiece. In operation, the front surface of the workpiece is immersed in the electroplating solution so that the anode and the workpiece establish an electrical field that causes metal ions in the electroplating solution to plate out onto the workpiece.

In so-called "wet-contact" reactors, the electrical contacts are exposed to the electroplating solution during a plating cycle. Consequently, the metal ions in the electroplating solution also plate out onto the contacts. The contacts, however, may plate at different rates with the result that some contacts can have a relatively greater or lesser surface area contacting the workpiece, as plated-on metal builds up on the contacts over time. This reduces the uniformity of the metal layer plated on the workpiece. It can also contaminate the workpiece via poorly adhering metal particles separating from the contacts and depositing onto the workpiece. To avoid this result, the contacts must be periodically "de-plated" to remove the metal that plates onto the contacts during a plating cycle, as part of ongoing maintenance of the reactor.

Typically, the contacts are deplated by immersing the contact assembly into the plating solution while passing reverse electrical current through them. The reverse current causes the plating cycle to reverse, moving metal off of the contacts and back into the solution. However, the reverse current must be limited to avoid degrading the plating solution. The rate of deplating is also limited by amount of agitation that can be provided to the plating solution around the contacts. Consequently, the contact deplating operation takes significant time to complete. This reduces the throughput or use efficiency of the electroplating reactors. Accordingly, improved designs for deplating contacts are needed.

SUMMARY OF THE INVENTION

A new electroplating apparatus having improved contact deplating features has now been invented. In one aspect, this new apparatus generally includes a bowl assembly having a bowl for holding an electroplating solution. A head having a rotor including a contact ring and a head motor for rotating the rotor cooperates with the bowl assembly during plating operations. A lift/rotate actuator may be used to move the head to position a sector of the contact ring in a ring slot or opening of a deplating module. Since the deplating is performed within the deplating module, and not within the bowl assembly, the disadvantages of existing deplating techniques are largely overcome.

In a new method for deplating contacts, a head of plating apparatus or reactor is lifted and then tilted to align a portion of a contact ring on the head with a deplating opening. The contact ring may be extended away from the head and into the deplating opening. The contact ring is rotated to move contacts on the contact ring sequentially through the deplating opening. The contacts are deplated in the deplating opening by exposing the contacts to reverse electrical current in the presence of a deplating solution. The contacts may also be rinsed and dried as they move through the deplating opening.

Other and further objects and advantages will become apparent from the following detailed description. The invention resides as well in subcombinations of the apparatus and methods described.

BRIEF DESCRIPTION OF THE DRAWINGS

In the drawings, the same reference number indicates the same element in each of the views.

DETAILED DESCRIPTION OF THE DRAWINGS

Figure 1:
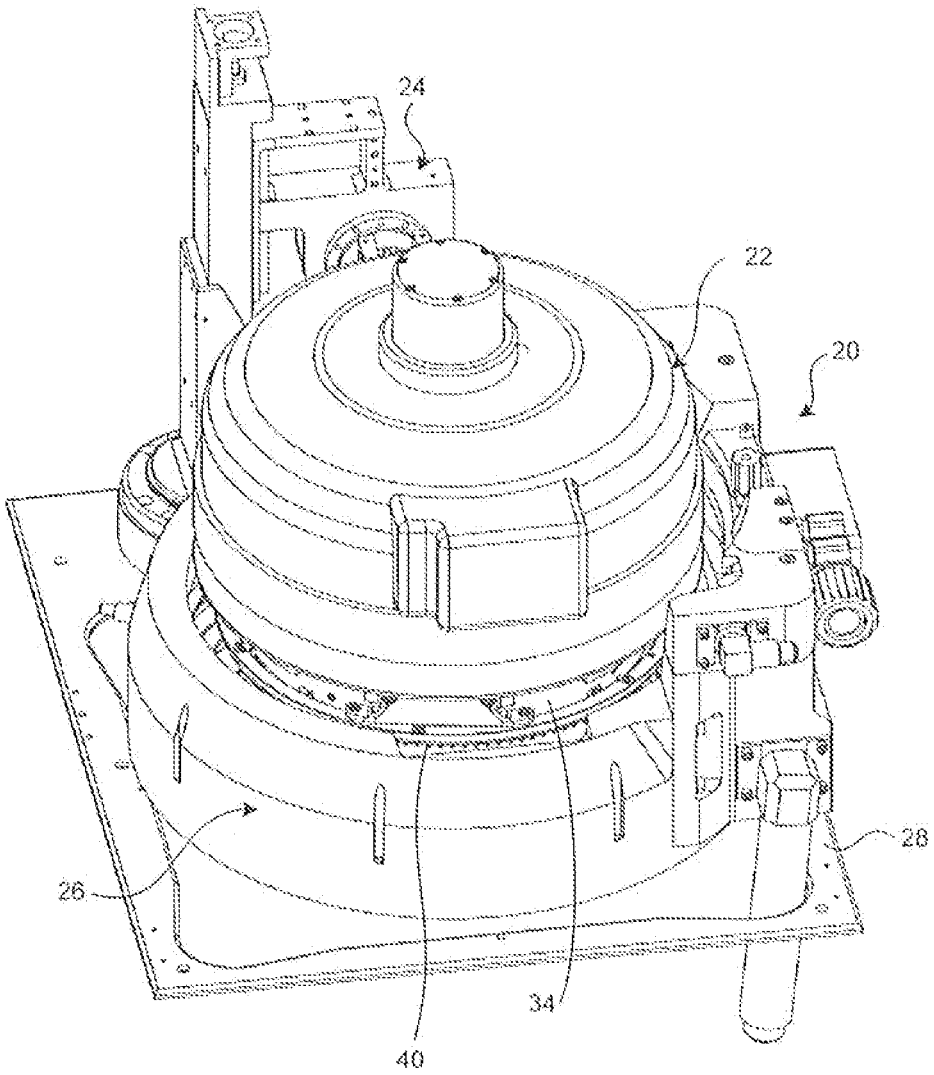
FIG. 1 is a perspective view of the present electrochemical plating reactor with the head engaged with the bowl assembly.
Figure 2:
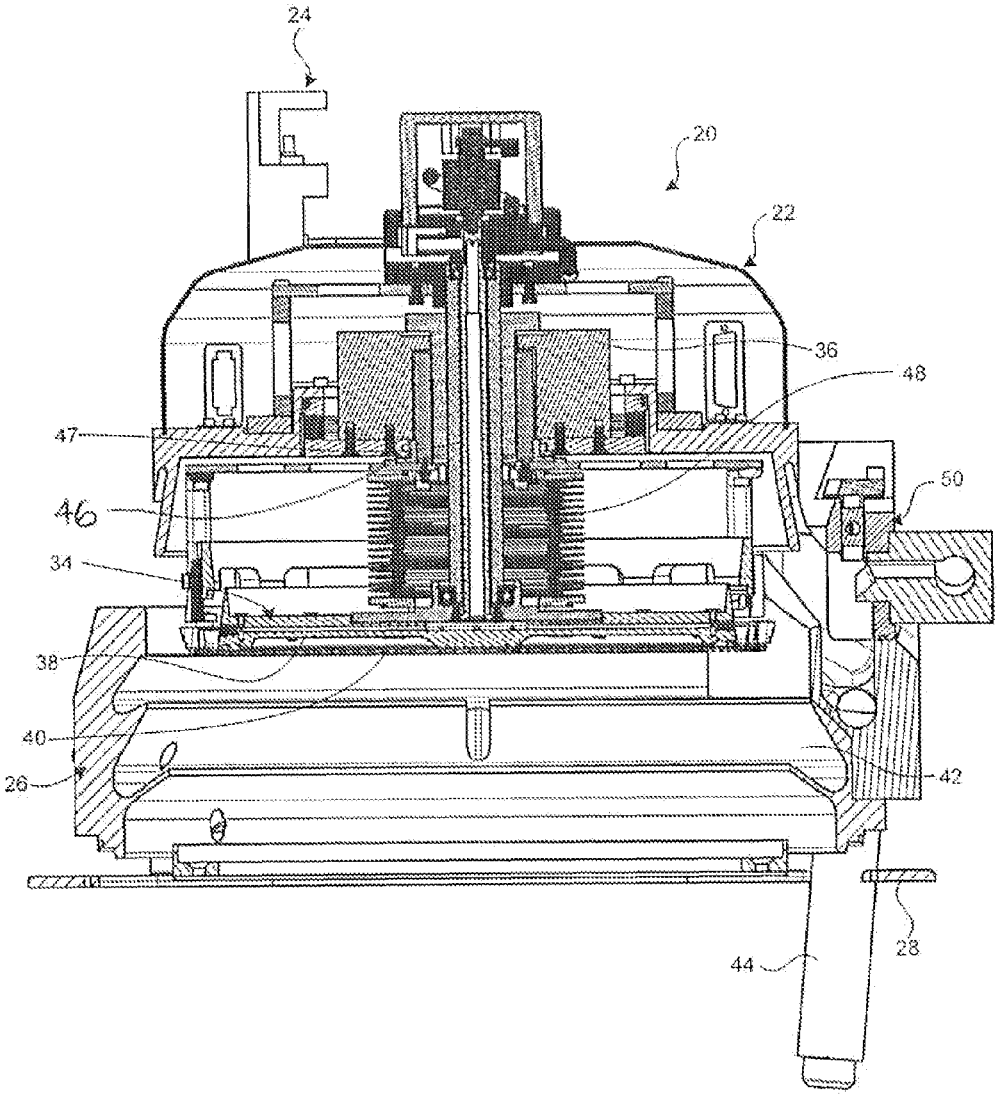
FIG. 2 is a cross section of the reactor as shown in FIG. 1.
Figure 3:
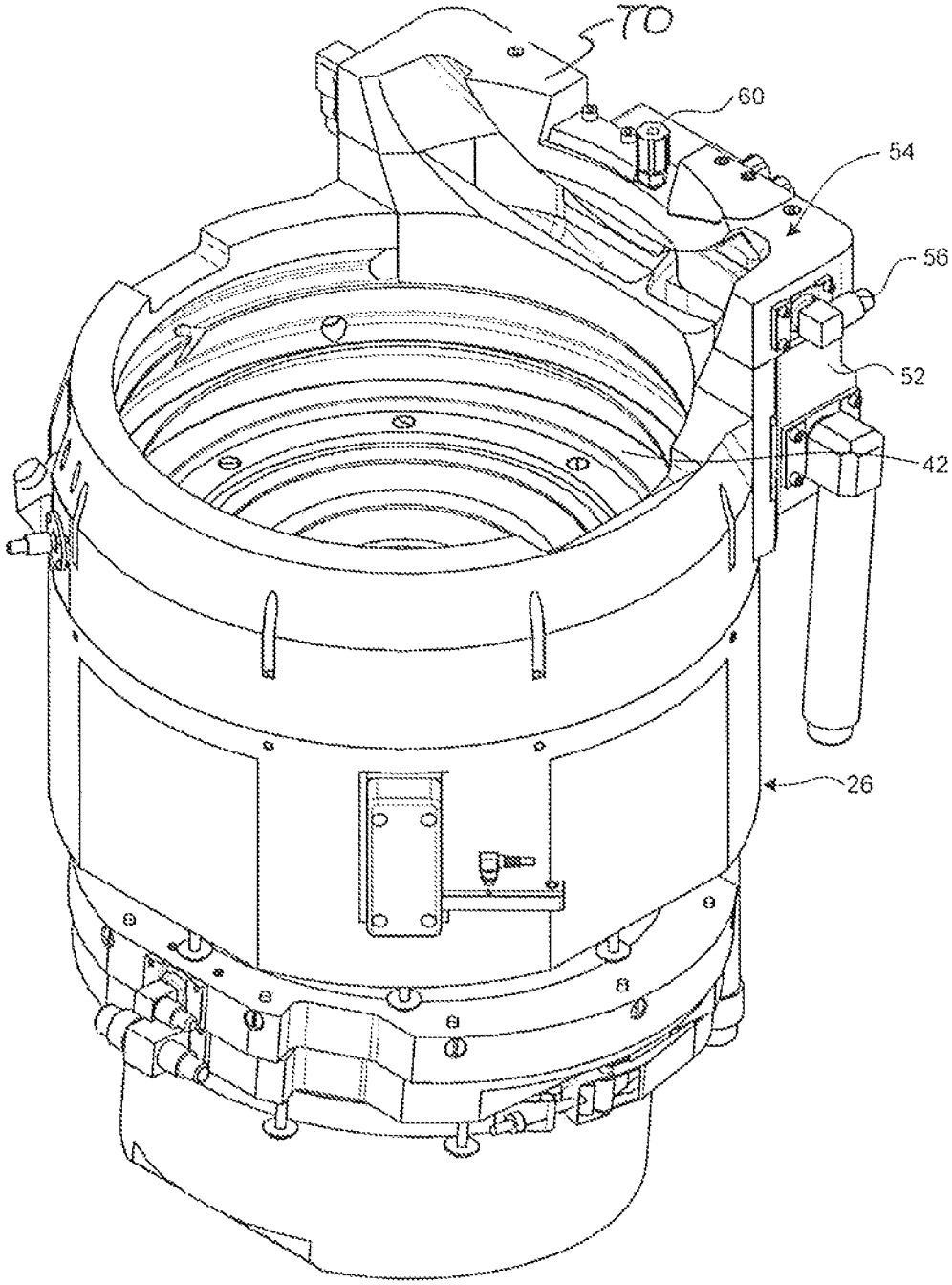
FIG. 3 is a front perspective view of the bowl assembly, including a deplating module.
Figure 4:
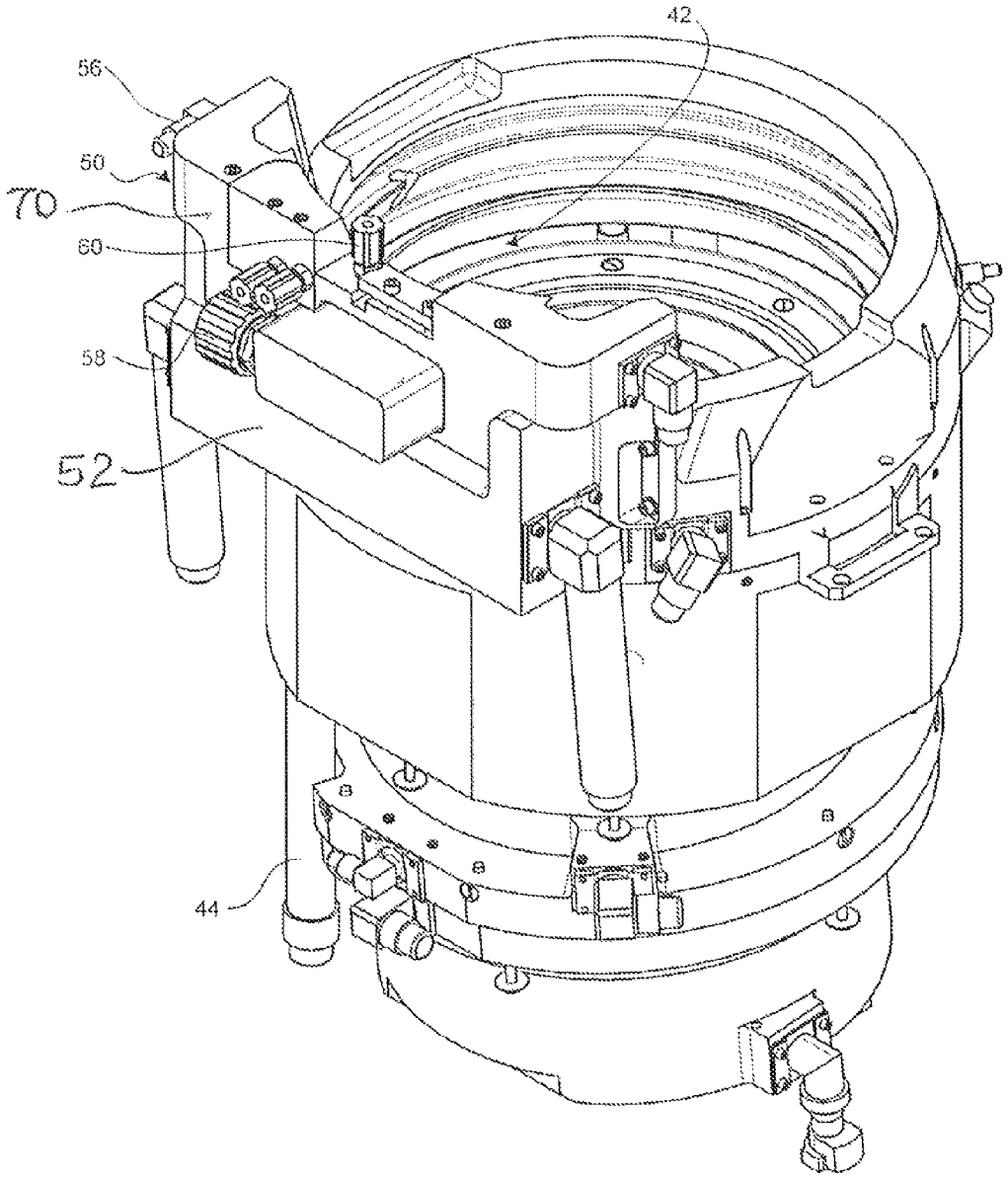
FIG. 4 is a rear perspective view of the bowl assembly.

Turning now in detail to the drawings, FIGS. 1 and 2 show the head 20, and FIGS. 3-4 show the bowl assembly 26, of an electroplating reactor or apparatus 20. The head is supported on a lift/rotate device 24, for example as described in U.S. Pat. No. 6,623,609, incorporated herein by reference. The lift rotate device 24 and the bowl assembly 26 are attached to a deck plate 28 or similar structure. A bowl assembly as described in U.S. Pat. No. 7,665,398 B2, incorporated herein by reference, may be used. As shown in FIGS. 2-4, the bowl assembly 26 may include a drain ring 42 having one or more drain levels 49 and drain pipes 44. In a typical design, multiple reactors 20 may be provided in rows within an electroplating system, with a process robot moveable from a workpiece load/unload station to each of the reactors, as described in U.S. Pat. Nos. 7,351,314 and 7,371,306, incorporated herein by reference.

Figure 8:
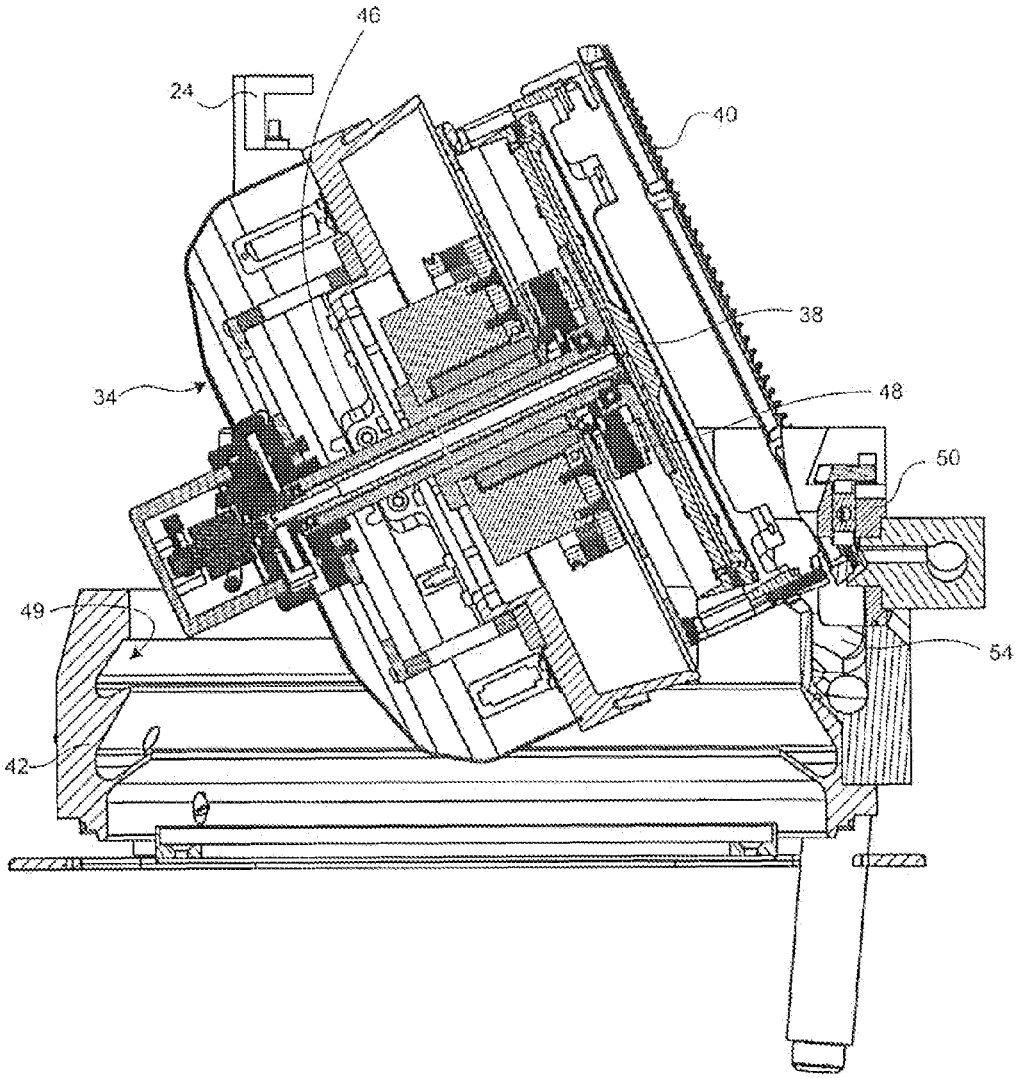
FIG. 8 is a section view of the head and deplating module as shown in FIG. 7.
Figure 11:
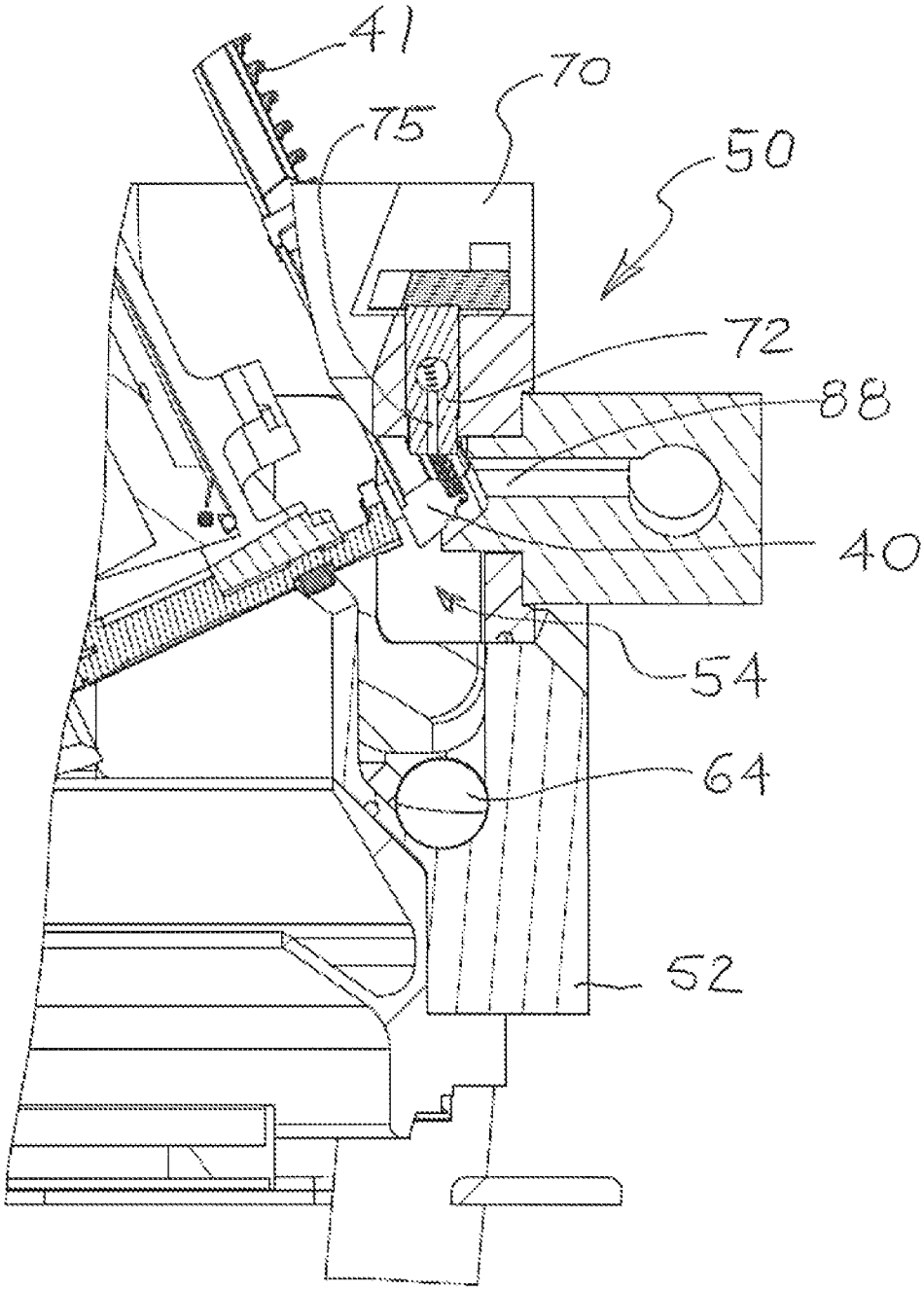
FIG. 11 is an enlarged partial section view through an electrode in the deplating module.

As shown in FIG. 2, the head 22 includes a rotor 34 linked to a rotation motor 36 by a shaft 47. The rotor 34 typically includes a contact ring 40 and a backing plate 38. The contact ring 40 generally has multiple spaced apart individual contacts 41, as shown in FIG. 11. The contacts described in U.S. Patent Application Publication 2006/0289302, incorporated herein by reference, may be used. A contact ring actuator 46 in the head 22 is attached to the contact ring 40 and can move the contact ring 40 linearly towards and away from the backing plate 38, along the axis of rotation of the rotor. The contact ring actuator 46 may move the contact ring 40 from load/unload position, where the contact ring is spaced apart from the backing plate 38, to a process position, where the contact ring is adjacent to the backing plate 38. A bellows 48 may be provided around the shaft 47 to help seal components in the head 22 from process chemicals. In FIG. 2, with the rotor in the process position, the actuator 46 is retracted and the bellows is extended. In FIG. 8, the actuator 46 is extended and the bellows 48 is compressed.

Figure 9:
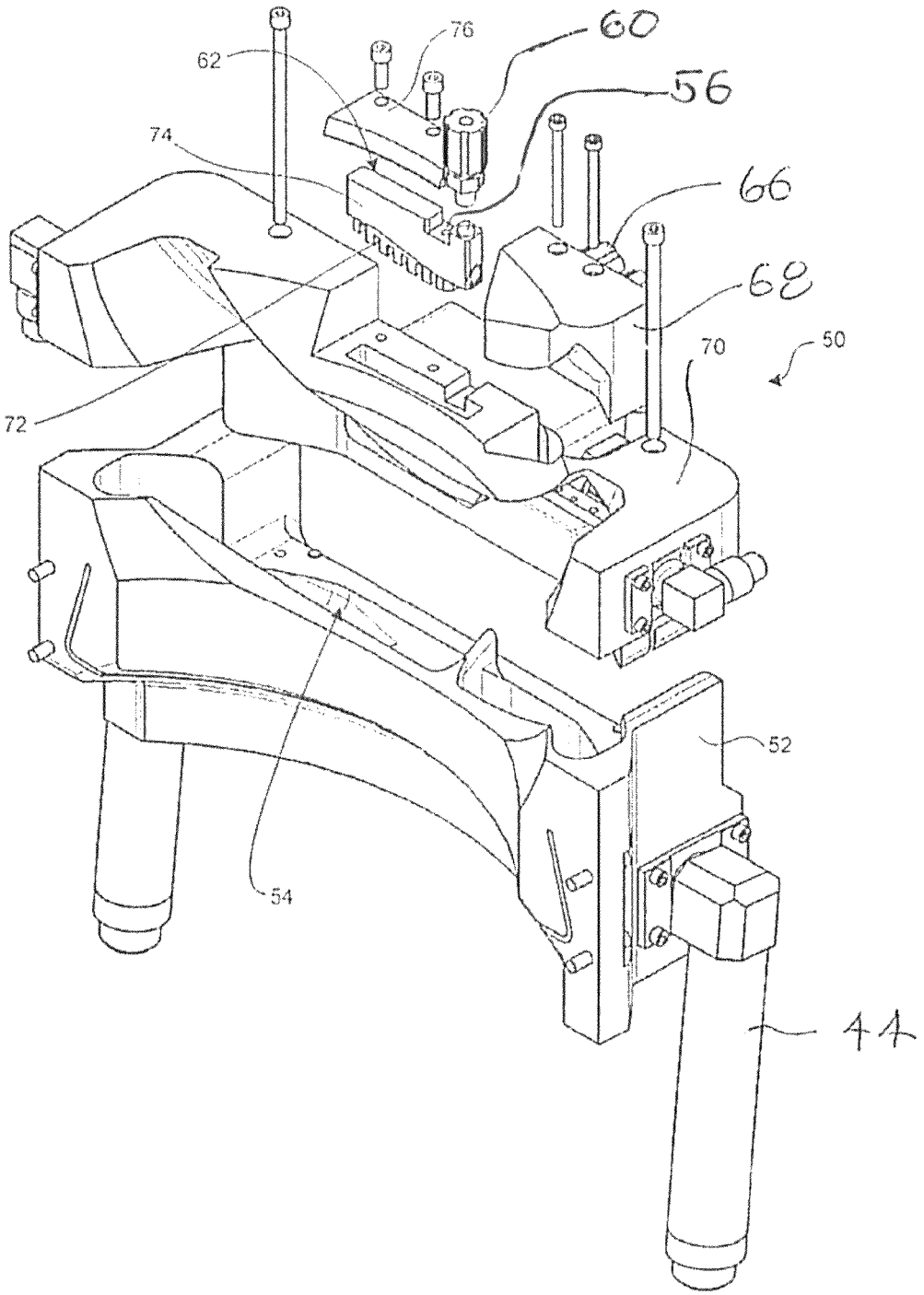
FIG. 9 is an exploded front perspective view of the deplating module.
Figure 10:
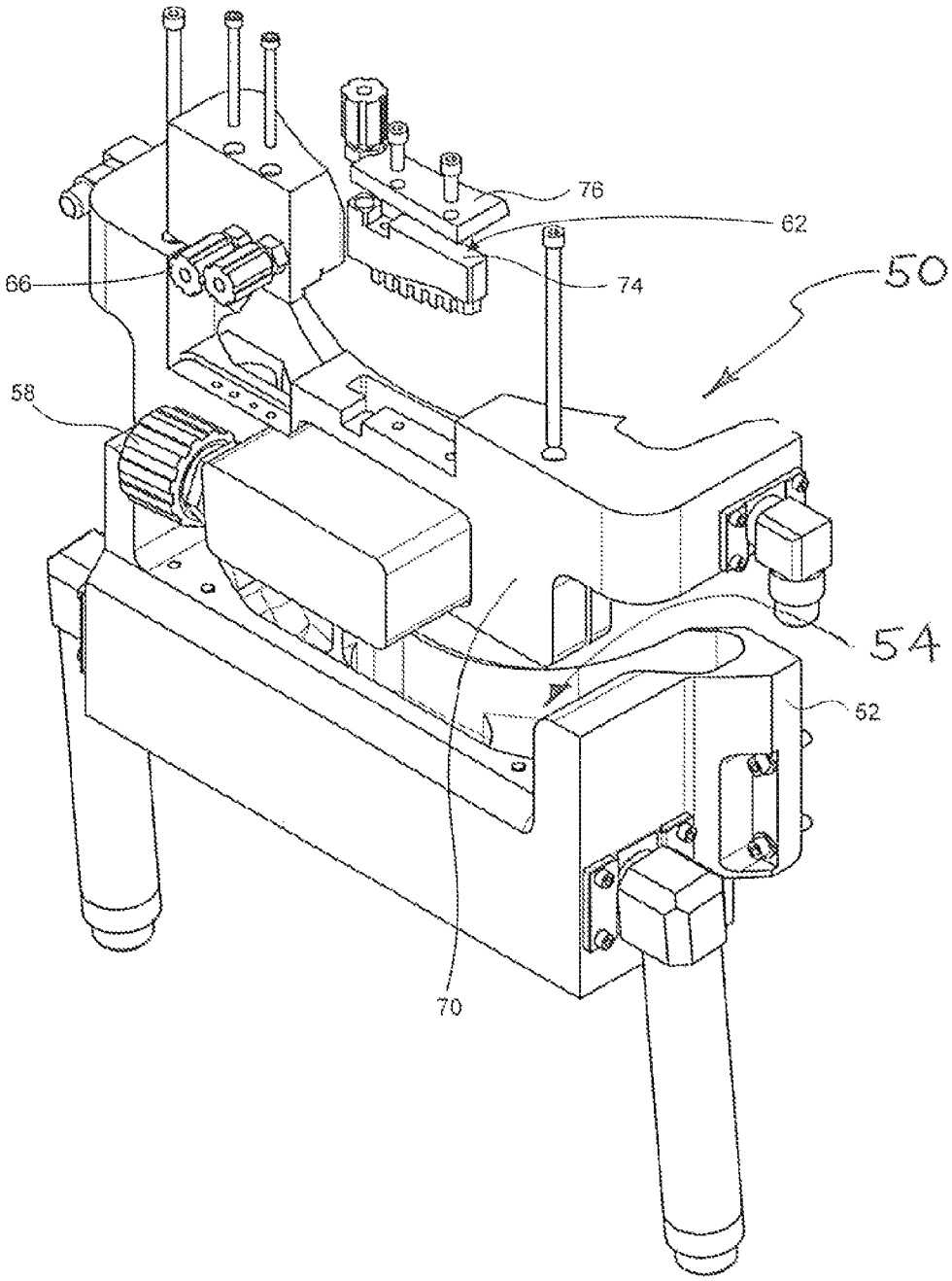
FIG. 10 is an exploded rear perspective view of the deplating module.

Referring to FIGS. 9-13, a contact maintenance module 50 has a chassis or base 52 providing a space or position for deplating contacts 41. This may be a ring slot or groove 54 sized and shaped to receive a portion or sector of the contact ring 40. A manifold 70 is attached on top of the base 52. A manifold 70 having ports and flow channels is attached on top of the base 52. An electrode assembly 62 having, at least one electrode 72, and a deplating fluid supply, is provided in the manifold 70. Holes in the electrode block 72 linked to the deplating fluid supply via a fitting 60 may form multiple streams of deplating liquid spaced apart to align with adjacent contacts. As shown in FIG. 9, the electrode assembly 62 may include a connector notch 56, and an electrode block 74 having multiple electrodes 72, with a retainer plate 76 securing the electrode block 74 into the manifold 70.

A deplating fluid supply may be formed via one or more fluid fittings 60 on a fluid distributor block 68 attached to the manifold 70. The contact maintenance module 50 may also be provided with a rinse port 78 in the manifold connected to a rinse fluid source and dry port 80 connected to drying fluid source, such as heated nitrogen gas, via fittings 66, as shown in FIGS. 9, 10, 12 and 13. One or more drain ports 64 leading to drain lines 44 may be provided to remove deplating fluid from the ring slot 54.

As shown in FIGS. 1, 9 and 11, the base 52 of the contact maintenance module 50 may be attached to the drain ring 42 at the top end of the bowl assembly 26. A portion of the drain ring may be cut out to provide an attachment position for the base 52. As shown in FIG. 3, the ring slot 54, where deplating is performed, is above and separate from the interior space of the bowl assembly 26, which space typically holds an electroplating solution.

Figure 5:
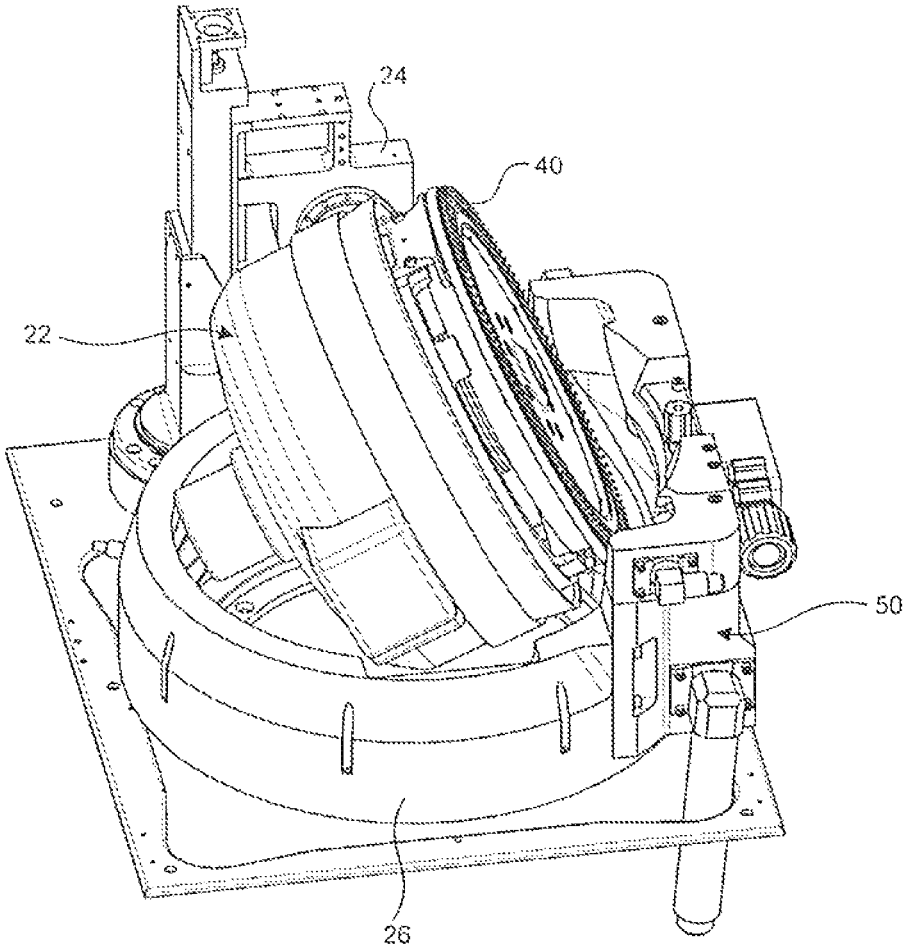
FIG. 5 is a perspective view of the head positioned for deplating.
Figure 6:
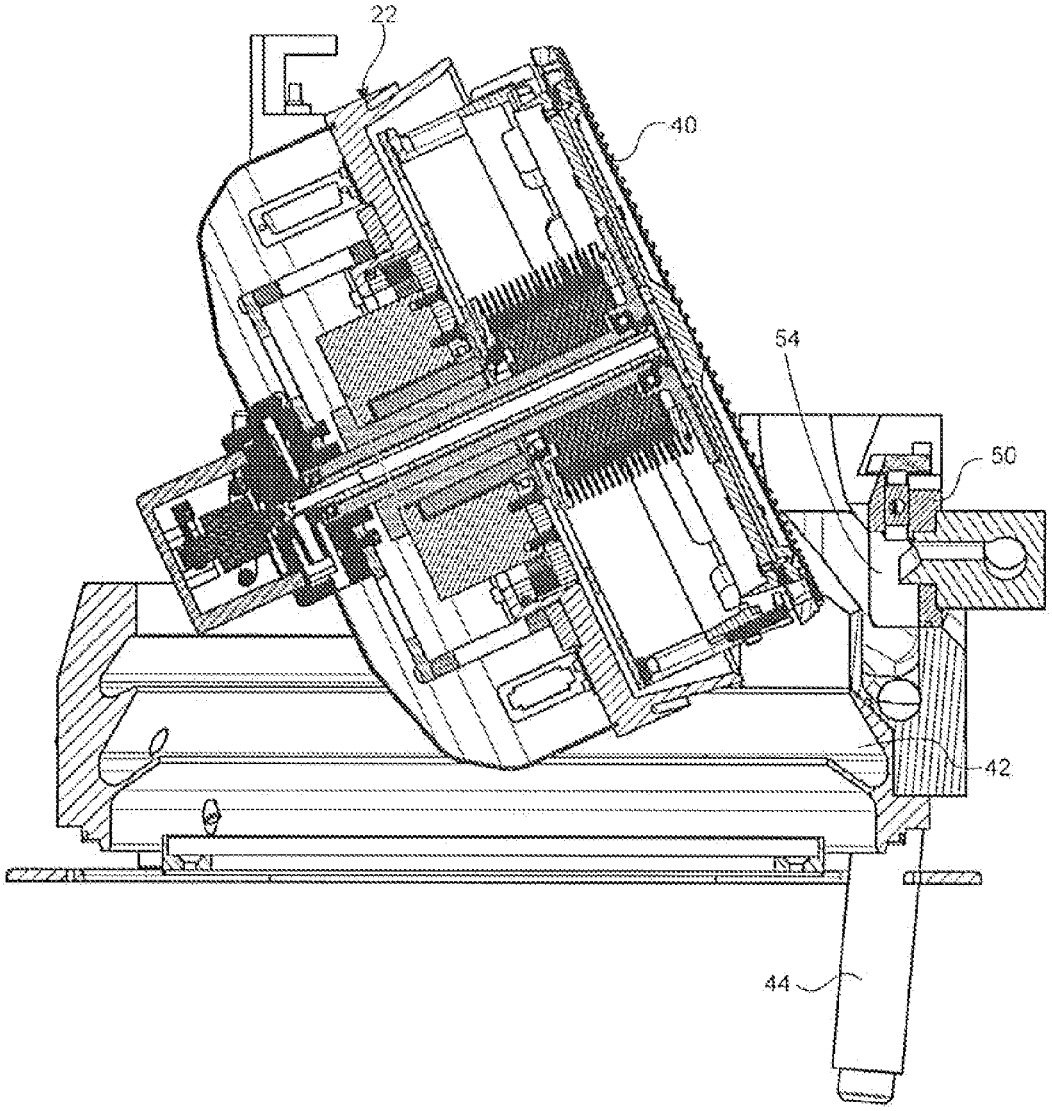
FIG. 6 is a section view of the head and deplating module as shown in FIG. 5.

Turning to FIGS. 5 and 6, to deplate the contacts 41, the lift/rotate device 24 lifts the head 22 up and away from the bowl assembly 26, and then rotates the head 22 to bring the contact ring 40 into alignment with the contact maintenance module 50. The head is lifted sufficiently so that it clears the drain ring 42 during the rotate movement. Depending on the specific dimensions of the components, this movement of the head 22 from the position shown in FIGS. 1 and 2, into the position shown in FIGS. 5 and 6, may be achieved with a single lift and a single rotate movement, or with multiple up/down and rotation movements, so long as the contact ring 40 becomes generally aligned with the ring slot 54 of the contact maintenance module 50, as shown in FIG. 6.

Figure 7:
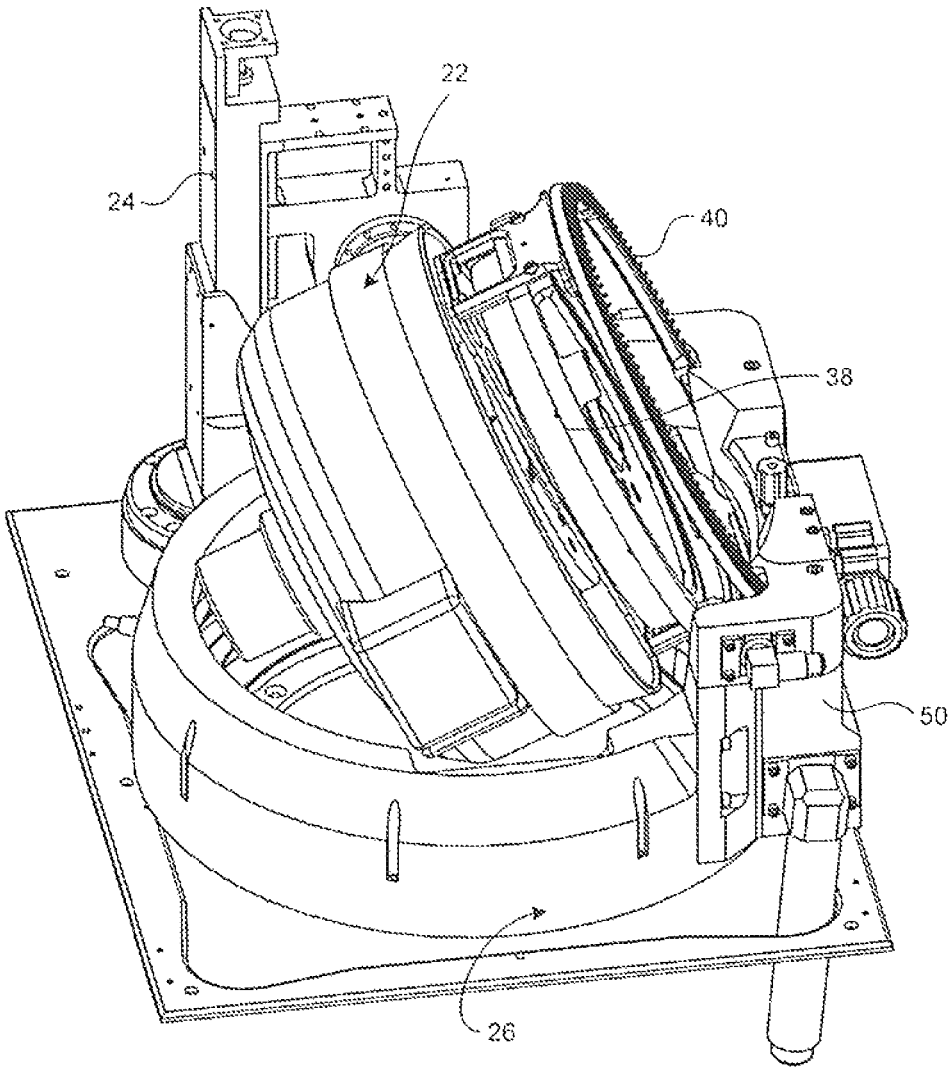
FIG. 7 is a perspective view of the head positioned for deplating as in FIG. 5, and with the contact ring now extended out of the head and into the deplating module.

Referring now to FIGS. 7 and 8, the contact ring 40 is extended outwardly from the head via contact ring actuator 46. This moves the lower portion of the contact ring 40 into the ring slot 54. Specifically, a sector of the contact ring subtending an arc of about 10° to about 45° is moved laterally into the ring slot 54. The contacts 41 are adjacent to the electrodes 72, as shown in FIG. 11. A deplating fluid flows through the fitting 60 into one or more bores in the manifold 70 and the electrode block 74 and onto the contacts 41. At the same time, a reverse electrical current flows from the electrodes 72 through the deplating fluid and the contacts 41. A reverse voltage of about 10-20 VDC may be applied to the electrodes. This creates a deplating process that removes accumulated metal plated onto the contacts 41. As shown in FIG. 11, the deplating fluid may flow out onto a contact 41 via a central opening 75 in an electrode 72. As shown in FIG. 9, multiple electrodes 72 may be provided on an electrode block 74, with the electrodes 72 arranged to generally match the curvature of the contact ring 40. In this design, multiple contacts 41 may be simultaneously depleted.

Figure 12:
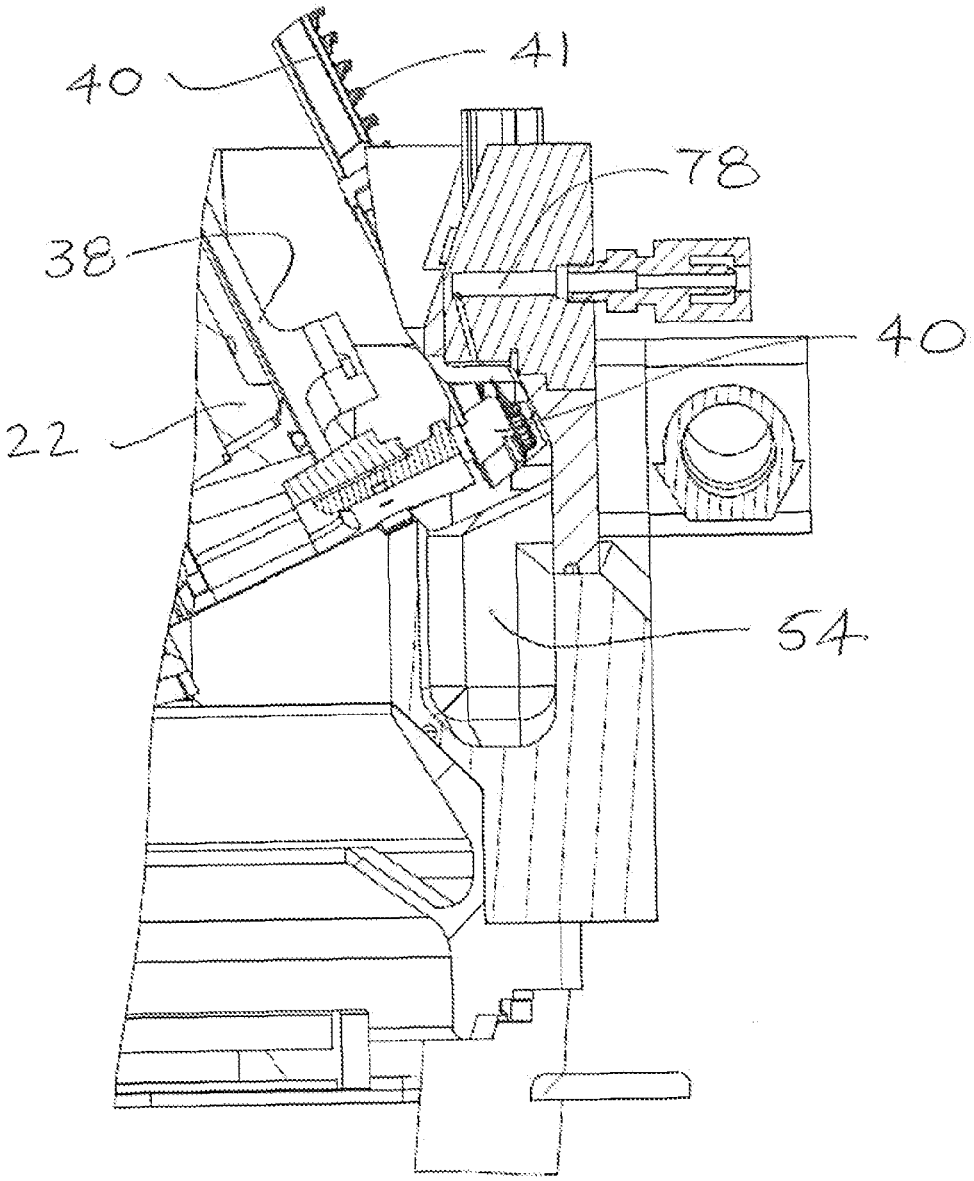
FIG. 12 is an enlarged partial section view through a rinse fluid outlet in the deplating module.

The rotation motor 36 in the head slowly rotates the rotor 34, causing the contact ring 40 to continuously or intermittently move through the ring slot 54. As a result, all of the contacts 41 on the contact ring 40 may be deplated. As shown in FIG. 12, with the rotor 34 slowly rotating, the contacts 41 move from a position aligned with the electrodes 72 to a position aligned with a rinse port 78. A rinse liquid, such as water, flows or is sprayed out from one or more rinse ports 78 onto the contacts 41. The used rinse liquid and the used deplating fluid collect at the bottom of the ring slot 54 and may be drawn off via a drain channel 64 shown in FIG. 11. The drain channel 64 leads to drain lines 44 and then to a facility drain line.

The deplating fluid and the rinse liquid do not enter the bowl assembly 26. Consequently, the plating solution in the bowl assembly 26 is not affected by the deplating process. The ring slot 54 may optionally be provided with separate drain channels for the deplating fluid and the rinse liquid. The deplating fluid can then be recycled and reused. The deplating fluid may be the same as the plating solution contained in the bowl assembly 26, or it may be a different liquid specifically formulated for deplating.

Figure 13:
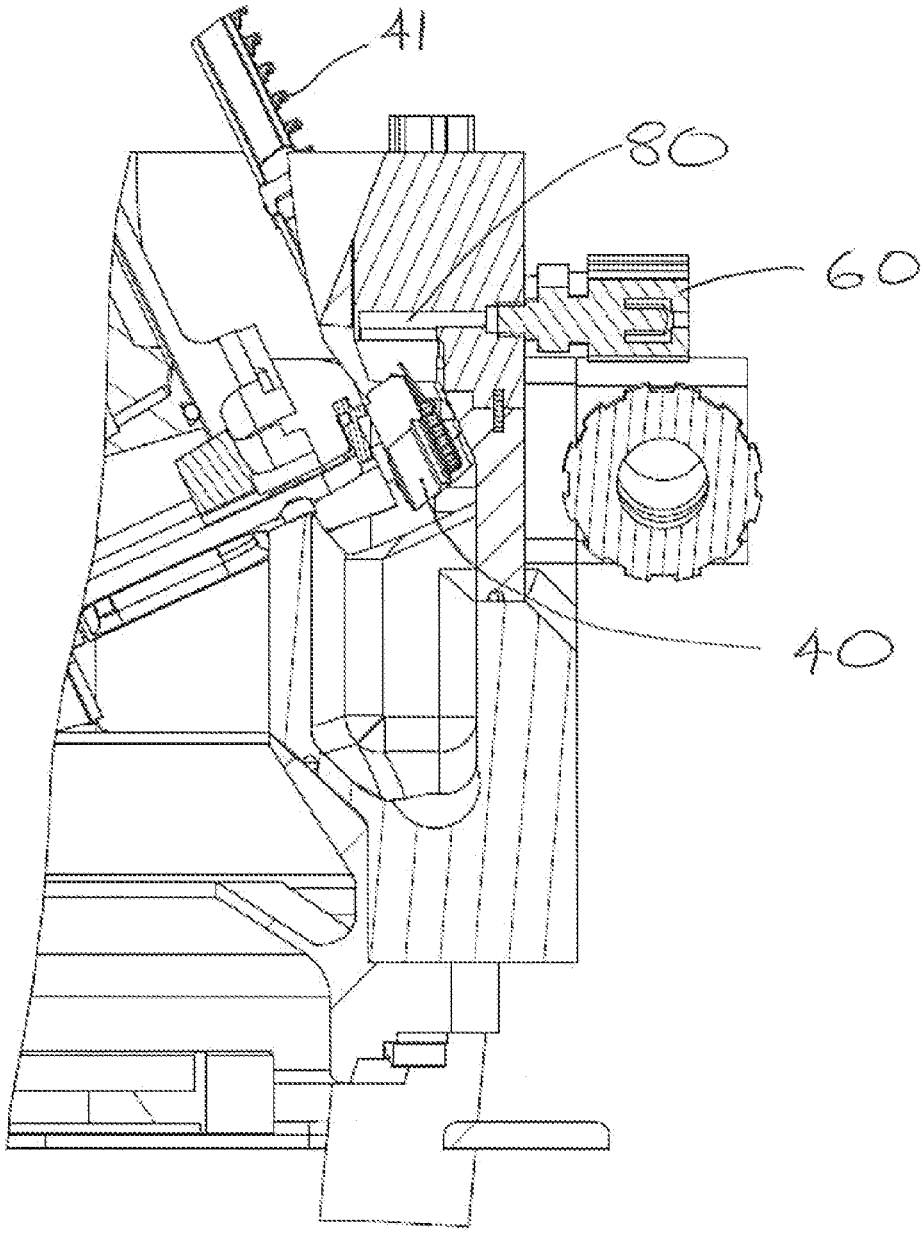
FIG. 13 is an enlarged partial section view through a drying fluid outlet in the deplating module.

FIG. 13 shows an optional drying port 80 located behind the rinse port 78 (in the direction of rotation of the contact ring 40). The contacts 41 may be dried as they pass under the drying port 80 via a flow of a drying gas, such as heated clean dry air or nitrogen.

During the deplating process, the motor 36 may move the rotor 36 and the contact ring 40 slowly and continuously without stopping, until all of the contacts 41 on the contact ring 40 have passed through the ring slot 54 and undergone the deplating process one or more times. Alternatively, the motor 36 may move the contact ring 40 incrementally or step-wise through the ring slot 54, with each contact 41 incrementally and sequentially moved through the deplating, rinsing and drying positions, or with a group of from 2 to about 20 contacts moved together through these three positions.

Depending on the design of the contacts and the contact ring, it may be advantageous to pass all of the contacts through the deplating module 50, with the contacts at a first position relative to the electrode(s), for example at a position better adapted to deplate the base of each contact (closer to where the contact is attached to the contact ring). Then the contacts may also make a second pass through the deplating module 50 at a second position relative to the electrode(s), for example with the second position better adapted to deplate the body and/or tip of the contacts. In this method, after the first pass through the deplating module, (i.e., a full rotation of the rotor), the contact ring is withdrawn or retracted slightly away from the electrode(s) 72, for example by about 1-2 or 3 mm.

Consequently, in this method, a head of a plating reactor is pivoted to align a contact ring on a rotor in the head with ring opening in a deplating module. A sector of the contact ring is moved, or extended outwardly from the head, at least partially into the ring opening. An electrically conductive liquid flows over, past or through one or more deplating electrodes in the deplating module, while electrical current flows through the contact ring, the contacts, the conductive liquid and the deplating electrodes. The rotor rotates to move each contact on the contact ring through the deplating module. The contact ring may be rotated once through the deplating module at a first position relative to the deplating electrodes, and then shifted to a second position relative to the deplating electrodes for a second pass through the deplating module.

While FIGS. 7 and 8 show the contact ring 40 extended out from the head 22, in principal the contact maintenance module 50 may also work to deplate contacts on a contact ring 40 having more limited or even no movement relative to the head. This may be achieved via a modified lift/rotate device 24 that can also move the head 22 laterally to position the contact ring 40 into the ring slot 54 for deplating, and to back the head 22 away from the ring slot 54 to return the head 22 to the process position shown in FIGS. 1 and 2. Alternatively, the contact maintenance module 50 may be movable relative to the head, so that the ring slot moves over the contact ring, instead of vice versa. A combination of movements of both the head and the contact maintenance module may also be used.

Deplating the contacts may tend to create stray metal particles, as well as sulfuric acid particles, which can cause contamination. It can therefore be advantageous to provide one or more aspiration ports in the manifold adjacent to the contacts in the manifold 70 which may be in between the rinse and dry ports. Aspiration ports, such as port 88 in FIG. 11, may be connected to an aspiration fitting 58 shown in FIG. 10 and positioned to aspirate at the location where the liquid flows onto the contacts. In designs using multiple electrodes 72, an aspiration port may be associated with each electrode. The drying ports, if any, may be separated or partially isolated from the aspiration ports, to control air flow within the deplating module to better avoid escaping particles.

Figure 14:
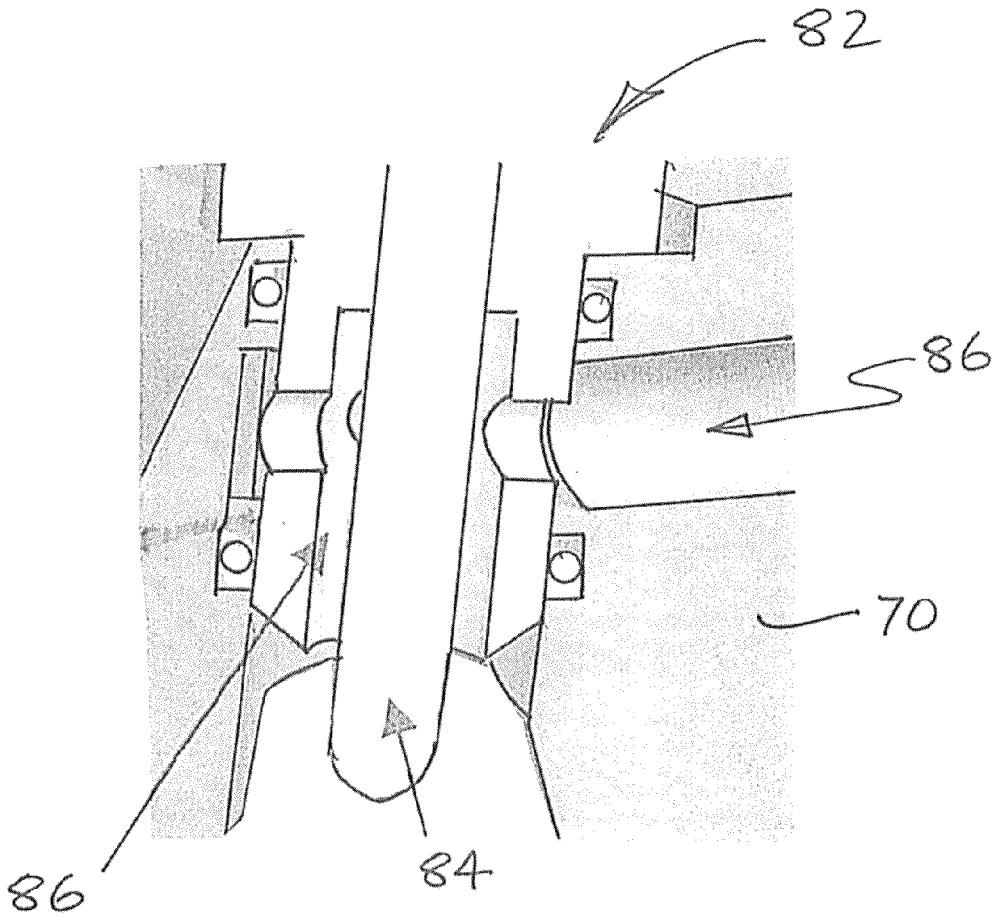
FIG. 14 is an enlarged perspective section view of an alternative deplating electrode design.

Various deplating electrode designs may be used in the contact maintenance module. FIG. 14 shows a deplating electrode design 82 having a center electrode 84 surrounded by a liquid flow path. The deplating liquid enters the manifold 70 from a side port, flows through an annular space around the center electrode 84, and then out of the manifold and onto a contact 41 positioned under the electrode 84. In an alternative design, the center electrode 84 may be omitted and a fitting may be used as the electrode. In this alternative design, the annular lower end of the electrode surrounds the liquid flow path.

Thus, novel apparatus and methods have been shown and described. Various changes and substitutions may of course be made without departing from the spirit and scope of the invention. The invention, therefore, should not be limited, except by the following claims, and their equivalents.

The invention claimed is:

1. Electroplating apparatus comprising:

a bowl assembly including a bowl for holding an electroplating solution;

a head including a rotor having a contact ring and a head motor for rotating the rotor;

a lift/rotate actuator attached to the head;

a deplating module attached to the bowl and having a ring opening adapted to receive a sector of the contact ring;

wherein the lift/rotate actuator is movable to engage the head with the bowl during plating operations, and to position a sector of the contact ring at least partially into the ring opening of the deplating module to deplate the contact ring.

2. The electroplating apparatus of claim 1 wherein the head further comprises a contact ring extending actuator for moving the contact ring linearly in a direction perpendicular to a plane of rotation of the rotor.

3. The electroplating apparatus of claim 1 wherein the ring opening forms an arcuate slot.

4. The electroplating apparatus of claim 1 further comprising one or more deplating electrodes in the deplating module adjacent to the ring opening, and an aspiration port adjacent to the depleting electrode.

5. The electroplating apparatus of claim 4 further comprising a deplating solution bore in the deplating module associated with each of the deplating electrodes.

6. The electroplating apparatus of claim 1 further comprising a bowl drain in the bowl assembly and a deplating module drain in the deplating module, separate from the bowl drain.

7. The electroplating apparatus of claim 2 further comprising a controller linked to the lift/rotate actuator, the head motor, the ring extending actuator and the deplating module, with the controller adapted to align the contact ring of the head with the ring opening of the deplating module, extend the contact ring so that a sector of the contact ring is at least partially into the ring opening, and to rotate the contact ring to move substantially all sectors of the contact ring sequentially through the ring opening, to deplate the contact ring.

8. The electroplating apparatus of claim 1 wherein the deplating module is fixed in place at an upper rim of the bowl assembly, and wherein the deplating module is positioned to the outside of the bowl assembly to avoid interfering with engagement of the head onto the bowl assembly.

9. Electroplating apparatus comprising:

a bowl assembly;

a head including a rotor and a head motor for rotating the rotor;

a contact ring attached to the rotor;

a head lifter/rotator supporting the head;

a deplater outside of and attached to the bowl having an arcuate ring slot;

wherein the head is movable via the head lifter/rotator from a first position wherein the rotor is within the bowl assembly, to a second position wherein a portion of the contact ring is at least partially in the arcuate ring slot of the deplater.

10. The electroplating apparatus of claim 9 further comprising an actuator in the head for moving the contact ring linearly in a direction parallel to a rotation axis of the rotor.

11. The electroplating apparatus of claim 9 further comprising deplating electrodes at the arcuate ring slot, and a deplating solution outlet adjacent to each of the deplating electrodes.

12. An electroplating machine for plating metal onto a round microelectronic wafer substrate, comprising:

a bowl assembly including a bowl for holding an electroplating solution;

one or more anodes in the bowl;

a head including a rotor and a head motor for rotating the rotor;

a backing plate on the rotor;

a contact ring on the rotor;

multiple individually spaced apart contacts on the contact ring;

a contact ring actuator in the head for moving the contact ring linearly towards and away from the backing plate;

an electrical current source connected to the contact ring and to one or more anodes;

a lift/rotate actuator attached to the head;

a deplater attached to the bowl;

a ring opening in the deplater;

one or more deplating electrodes in the deplater adjacent to the ring opening;

a deplating solution outlet adjacent to the deplating electrodes;

at least one aspiration port in the ring opening;

wherein the lift/rotate actuator is movable to position the head with the rotor in the bowl, and to position a portion of the contact ring into the ring opening of the deplater.

13. The apparatus of claim 3 further comprising one or more deplating solution outlets in the deplating module and wherein the aspiration port is positioned to aspirate at a location where deplating liquid flows out of the outlets and onto the contacts.

14. The apparatus of claim 12 wherein the aspiration port is positioned to aspirate at a location where deplating liquid flows out of the outlet and onto the contacts.

15. The electroplating apparatus of claim 1 further comprising multiple deplating electrodes in the ring opening, and an aspiration port adjacent to each of the deplating electrodes.

* * * * *